US010830183B2

(12) United States Patent
Krup

(10) Patent No.: US 10,830,183 B2
(45) Date of Patent: Nov. 10, 2020

(54) INDIVIDUAL CYLINDER TUNING BOOSTER FOR A CARBURETOR

(71) Applicant: William R. Krup, Mt. Carmel, IL (US)

(72) Inventor: William R. Krup, Mt. Carmel, IL (US)

( * ) Notice: Subject to any disclaimer, the term of this patent is extended or adjusted under 35 U.S.C. 154(b) by 79 days.

(21) Appl. No.: 16/210,978

(22) Filed: Dec. 5, 2018

(65) Prior Publication Data

US 2020/0182197 A1 Jun. 11, 2020

(51) Int. Cl.

| | |
|---|---|
| ***F02M 9/12*** | (2006.01) |
| ***F02M 17/48*** | (2006.01) |
| ***F02M 19/10*** | (2006.01) |
| ***B01F 3/04*** | (2006.01) |
| ***F02M 9/127*** | (2006.01) |
| ***F02M 9/08*** | (2006.01) |
| *F02M 21/02* | (2006.01) |
| *F02M 9/10* | (2006.01) |

(52) U.S. Cl.

CPC ..... *F02M 9/1275* (2013.01); *B01F 3/04* (2013.01); *F02M 9/085* (2013.01); *F02M 17/48* (2013.01); *F02M 19/10* (2013.01); *F02M 9/103* (2013.01); *F02M 21/0239* (2013.01); *F02M 21/0263* (2013.01)

(58) Field of Classification Search

CPC ..... B01F 3/04; F02M 19/10; F02M 17/48; F02M 9/1275

USPC ..... 261/23.2, 40, DIG. 12

See application file for complete search history.

(56) References Cited

U.S. PATENT DOCUMENTS

| | | | | |
|---|---|---|---|---|
| 1,758,954 A * | 5/1930 | Linn | ..... | F02M 17/48 261/41.2 |
| 2,255,296 A | 9/1941 | Moseley | | |
| 2,457,570 A | 12/1948 | Leibing | | |
| 3,847,125 A | 11/1974 | Malherbe | | |
| 3,873,650 A | 3/1975 | Lamkin | | |
| 4,375,438 A | 3/1983 | McKay | | |

* cited by examiner

*Primary Examiner* — Robert A Hopkins
(74) *Attorney, Agent, or Firm* — Stinson LLP

(57) ABSTRACT

A fuel discharge nozzle for discharging fuel into an airflow passageway of a barrel of a carburetor includes a nozzle body that is attached to the carburetor and has proximal and distal ends. The nozzle body defines a fuel inlet that receives fuel, spaced apart fuel outlets disposed between the proximal and distal ends of the nozzle body that permit the fuel to flow out of the nozzle body, and a fuel passage fluidly connecting the fuel inlet and the fuel outlets so that the fuel can flow from the fuel inlet to the fuel outlets. The nozzle body is sized and shaped to position the fuel outlets in the airflow passageway of the barrel of the carburetor when the nozzle body is attached to the carburetor so that the fuel flows into the airflow passageway of the carburetor and mixes with air after the fuel flows out of the fuel outlets.

19 Claims, 13 Drawing Sheets

FIG. 4
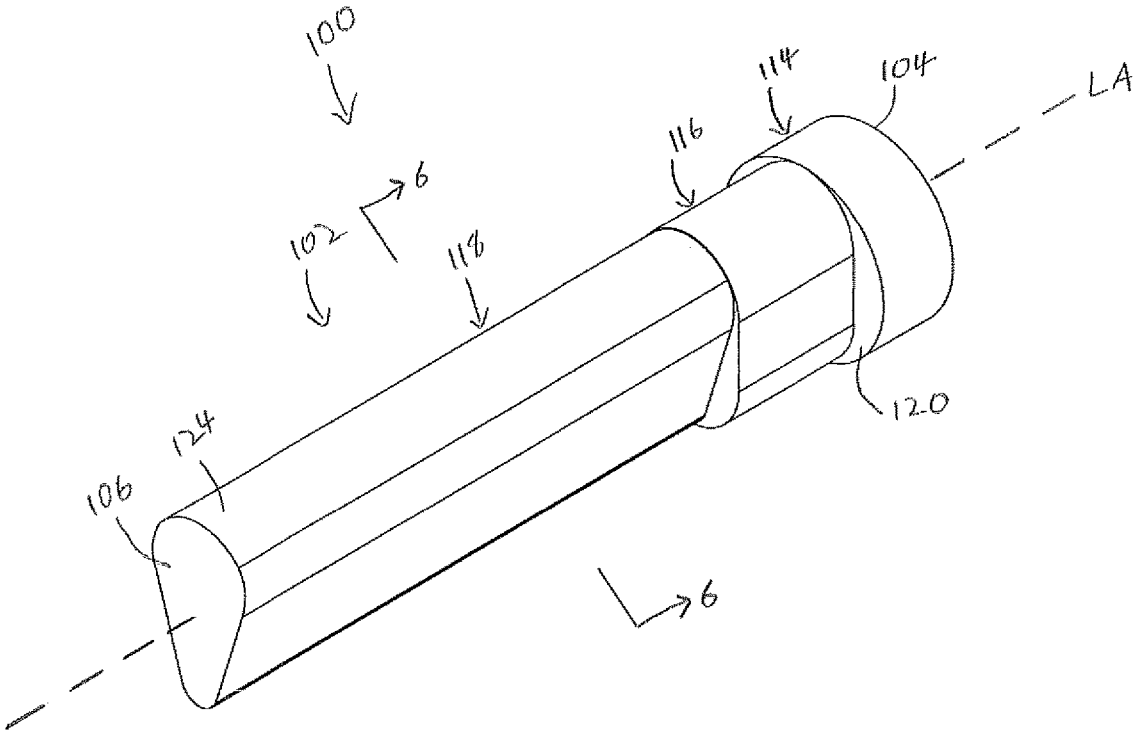
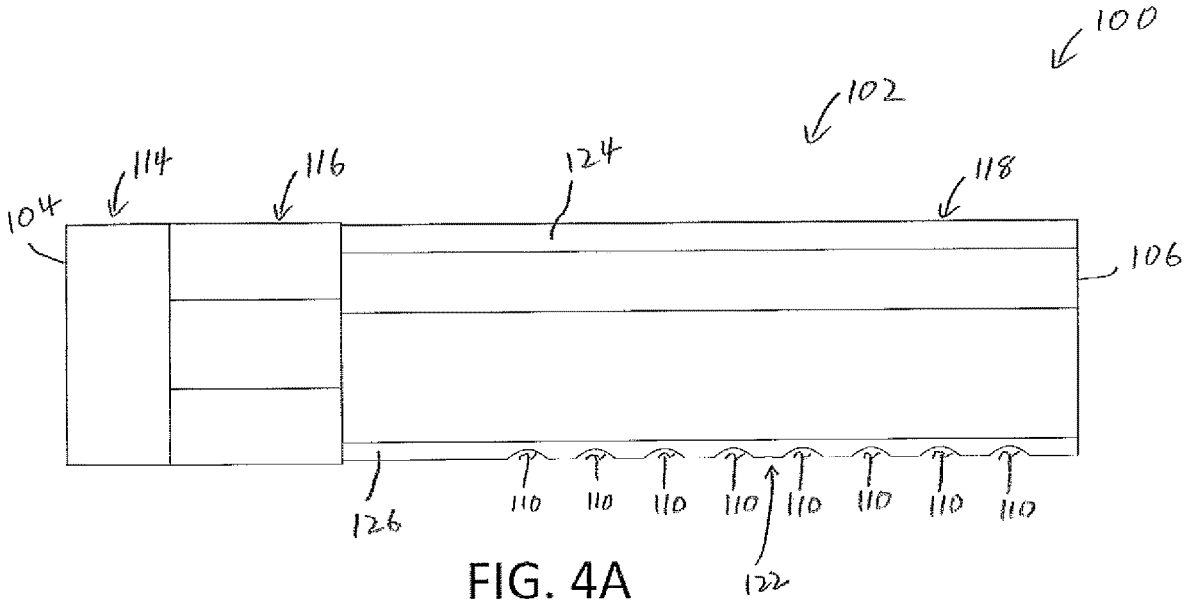
FIG. 4A

FIG. 5
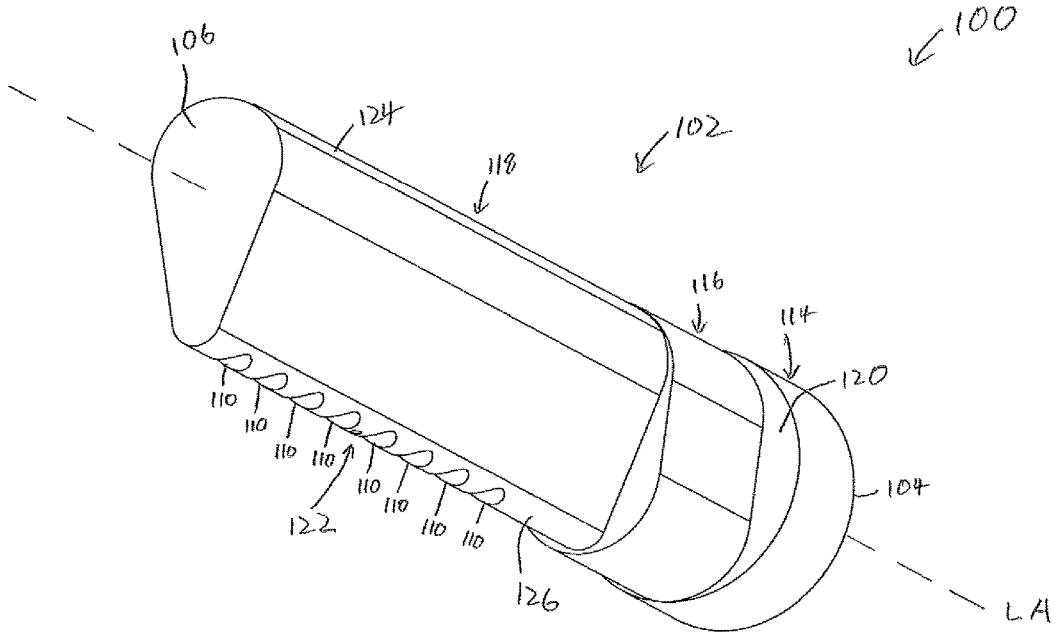
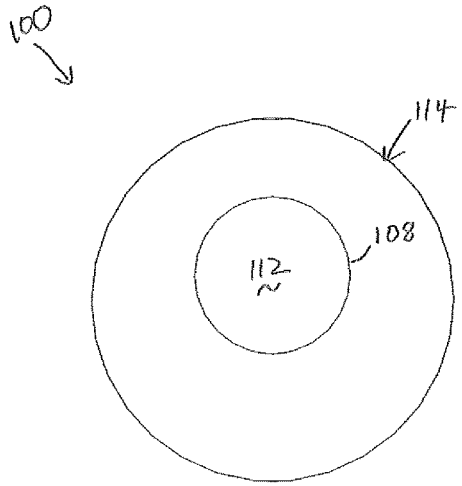
FIG. 5A
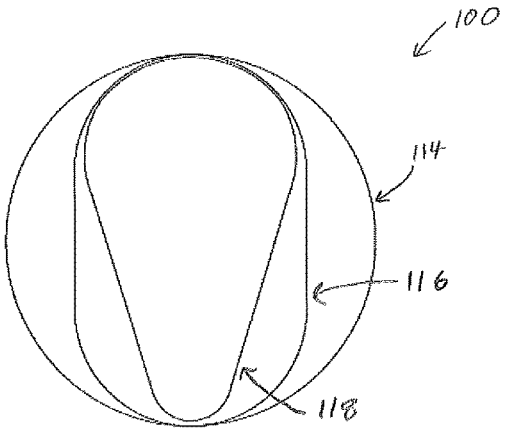
FIG. 5B

INDIVIDUAL CYLINDER TUNING BOOSTER FOR A CARBURETOR

FIELD

The present disclosure relates generally to a fuel discharge nozzle for distributing fuel in a carburetor.

BACKGROUND

Carburetors are used to deliver a fuel/air mixture to an engine (e.g., internal combustion engine) for combustion. Carburetors typically include a main body through which a stream of air from the air intake passes to the manifold, and one or more fuel discharge nozzles which delivers gasoline into the air stream to create the fuel/air mixture. The fuel discharge nozzles receive fuel from a fuel bowl holding a reservoir of gasoline that is coupled to the main body of the carburetor. The fuel is aspirated from the fuel discharge nozzle by a venturi created in the air stream by the main body of the carburetor. Carburetors include a throttle valve (or "base plate") located downstream of the fuel discharge nozzle to control the amount of fuel/air mixture delivered to the cylinders of the engine.

SUMMARY

In one aspect, a fuel discharge nozzle for discharging fuel into an airflow passageway of a barrel of a carburetor comprises an elongate nozzle body configured to be attached to the carburetor and has proximal and distal ends. The nozzle body defines a fuel inlet configured to receive fuel, spaced apart fuel outlets disposed between the proximal and distal ends of the nozzle body and configured to permit the fuel to flow out of the nozzle body, and a fuel passage fluidly connecting the fuel inlet and the fuel outlets so that the fuel can flow from the fuel inlet to the fuel outlets. The nozzle body is sized and shaped to position the fuel outlets in the airflow passageway of the barrel of the carburetor when the nozzle body is attached to the carburetor so that the fuel flows into the airflow passageway of the carburetor and mixes with air after the fuel flows out of the fuel outlets.

In another aspect, a carburetor for an internal combustion engine having at least at least two combustion cylinders comprises a body having at least one barrel formed therein defining an airflow passageway for the passage of air from outside the carburetor into the two cylinders of the internal combustion engine when the carburetor is attached to the internal combustion engine. A throttle valve is disposed in the barrel for controlling the amount of fuel and air that is passed from the barrel to the cylinders of the internal combustion engine. The throttle valve is constructed so that air and fuel flow on opposite sides of the throttle valve. A nozzle mounted on the carburetor body extends transversely across the barrel upstream of the throttle valve. The nozzle has an airfoil shape and defines a fuel inlet configured to receive fuel, at least one fuel outlet disposed between the proximal and distal ends of the nozzle and configured to permit the fuel to flow out of the nozzle, and a fuel passage fluidly connecting the fuel inlet and the fuel outlet so that the fuel can flow from the fuel inlet to the fuel outlets. The nozzle positioning the fuel outlet in the airflow passageway of the barrel of the carburetor so that the fuel flows into the airflow passageway of the carburetor and mixes with air as the fuel flows through the fuel outlets.

In another aspect, a method of tuning a carburetor to provide fuel/air mixtures to two cylinders of an internal combustion engine fed by a single barrel of the carburetor includes determining that a fuel/air mixture from the carburetor to at least one of the two cylinders deviates from a standard fuel/air mixture and installing a nozzle into the carburetor that is constructed to deliver a different amount of fuel on one side of the carburetor barrel than on the other side of the carburetor barrel to bring the fuel/air mixture of at least one of the two cylinders closer to the standard fuel/air mixture.

BRIEF DESCRIPTION OF THE DRAWINGS

FIG. 4 is a top perspective of a fuel discharge nozzle according to one embodiment of the present disclosure;

FIG. 4A is a left side view of the fuel discharge nozzle, the right side view being a mirror image thereof;

FIG. 5 is a bottom perspective of the fuel discharge nozzle;

FIG. 5A is a rear view thereof;

FIG. 5B is a front view thereof;

Corresponding reference characters indicate corresponding parts throughout the drawings.

DETAILED DESCRIPTION

Figure 1:
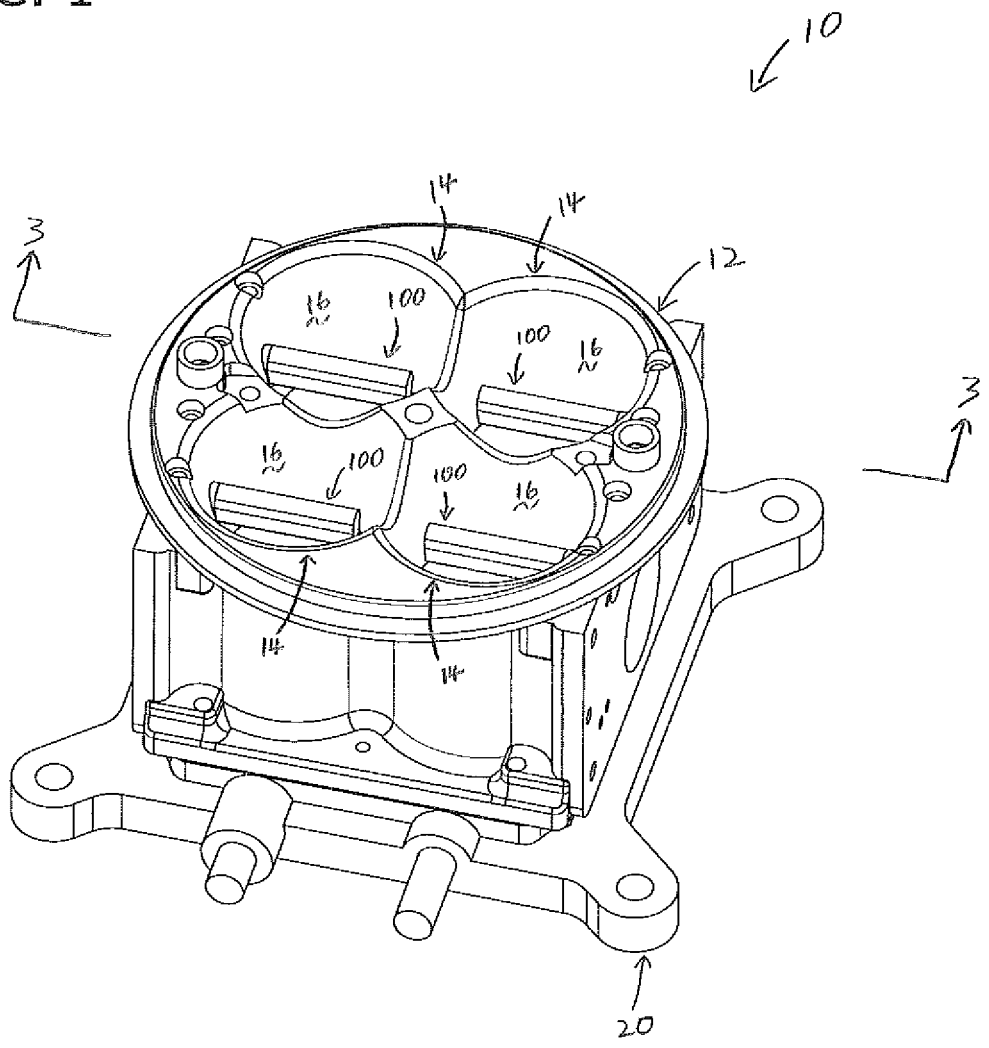
FIG. 1 is a perspective of one embodiment of a carburetor according to the teachings of the present disclosure.
Figure 2:
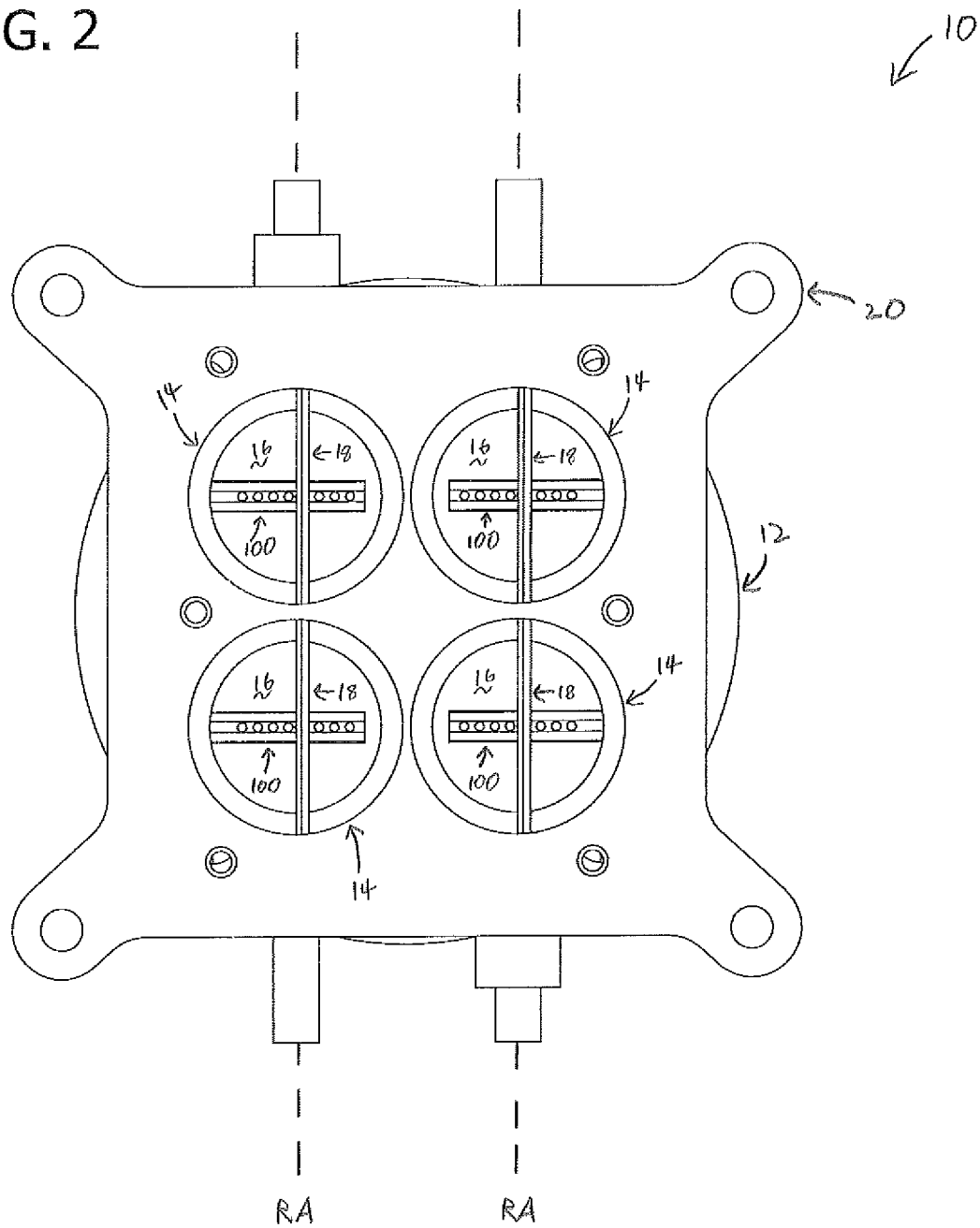
FIG. 2 is a bottom view thereof.
Figure 3:
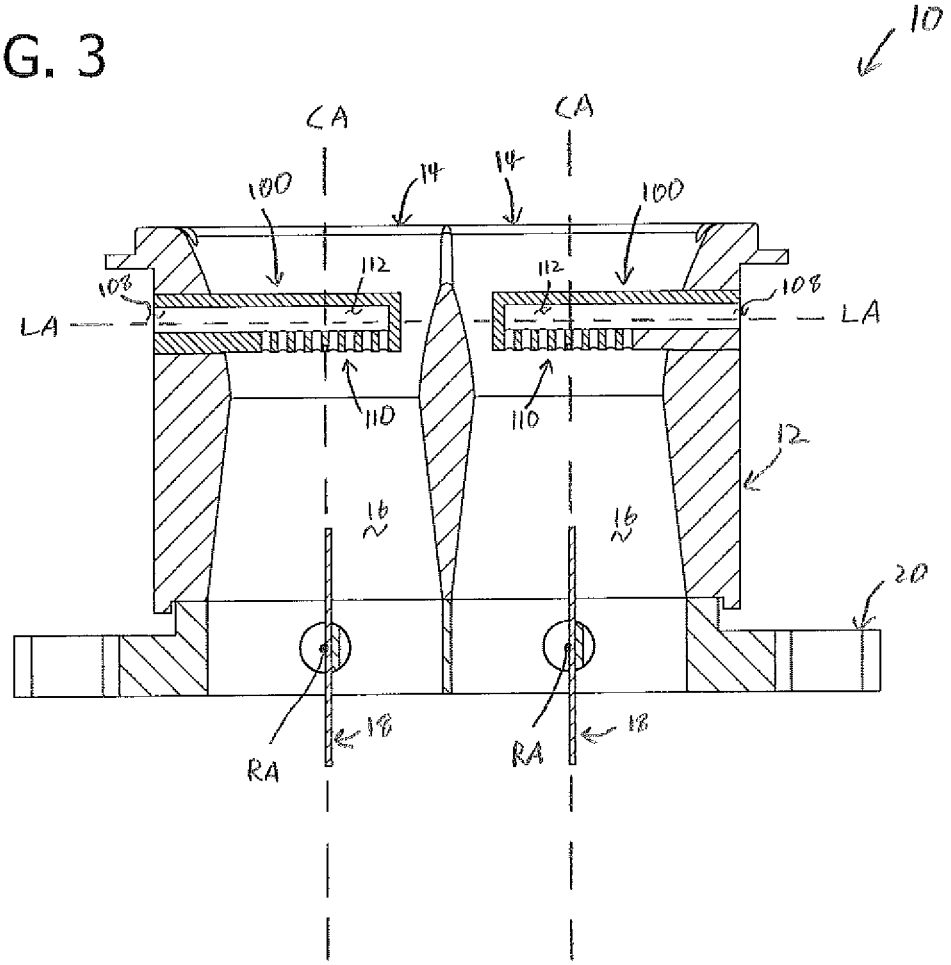
FIG. 3 is a section view taken through line 3-3 in FIG. 1.

Referring now to the drawings and in particular to FIGS. 1-3, one embodiment of a carburetor according to the teachings of the present disclosure is generally indicated at 10. The carburetor 10 includes a main body 12 having four barrels 14 formed therein. Each barrel 14 defines an airflow passageway 16 for the passage of air from outside the carburetor 10 into two cylinders of the internal combustion engine (not shown) when the carburetor is attached to the internal combustion engine. The illustrated carburetor is a four barrel carburetor of the type used with an internal combustion engine for a vehicle having eight cylinders, with each barrel providing the fuel/air mixture to two of the cylinders. It is understood the carburetor can be any type of carburetor, having any number of barrels 14, used for any type of gasoline engine. The carburetor 10 includes a throttle valve 18 disposed in each of the barrels 14 for controlling the amount of fuel and air (e.g., fuel/air mixture) that is passed from the barrel to the cylinders of the internal combustion engine. The throttle valve 18 is constructed so that fuel/air mixture flows on opposite sides of the throttle valve. For a barrel 14 that supplies the air/fuel mixture to two cylinders of the engine, generally, the portion of the fuel/air mixture that flows on (e.g., around) one side of the throttle valve 18 feeds one cylinder of the engine and the portion of the fuel/air mixture that flows on the other side of the throttle valve feed the another cylinder of the engine. Each throttle valve 18 is rotatably attached to a throttle valve housing 20 secured to the main body 12. The throttle valve housing 20 defines a portion of each barrel 14. In the illustrated embodiment, each throttle valve 18 is a butterfly valve. It is understood the throttle valve can be any type of throttle valve used in any type of carburetor. The orientation of the carburetor 10 in FIG. 1 provides the point of reference for the terms defining relative locations and positions of structures and components of the carburetor, including but not limited to the terms "upper," "lower," "left," "right," "top," "bottom," "forward," and "rearward," as used throughout the present disclosure. However, it is to be understood that other orientations and positions of the components may be used within the scope of the present invention.

An elongate fuel discharge nozzle (e.g., nozzle), generally indicated at 100, is disposed within each barrel 14 for discharging fuel into the airflow passageway 16 of the barrel of the carburetor 10. The fuel discharge nozzle may also be referred to as an individual cylinder tuning booster. As will be described in more detail below, each nozzle 100 has a configuration particularly selected to provide substantially the same fuel/air mixture to the two internal combustion engine cylinders fed by the barrel 14 of the carburetor 10. As is generally known in the art, each fuel discharge nozzle 100 receives fuel from a fuel bowl or other fuel source and discharges the fuel into the airflow passageway where the fuel mixes with air flowing through the airflow passageway to form the fuel/air mixture. Each nozzle 100 is mounted on the main body 12 and extends transversely across the barrel 14 (e.g., extends perpendicularly to a central axis CA defined by the barrel) upstream of the throttle valve 18. The nozzle 100 extends through and pass the center (e.g., central axis CA) of the barrel 14. The nozzle 100 also extends in a direction that is generally perpendicular to a rotational axis RA of the throttle valve 18. Accordingly, when attached to the main body 12 of the carburetor 10, the nozzle 100 is disposed over both sides of the throttle valve 18 and in both sides of the airflow passageway 16, the rotational axis RA dividing the sides of the throttle valve and airflow passageway. As shown in FIG. 3, the nozzle 100 is disposed in the airflow passageway 16 upstream of the constriction (e.g., smallest cross-sectional area) of the barrel 14 that generates the venturi. In addition to the nozzle 100, and acceleration pump (not shown) has an outlet above the location of the nozzle to supply additional fuel to the barrel during acceleration.

Referring to FIGS. 4-7, the nozzle 100 includes a nozzle body 102 configured to be attached to the main body 12 of the carburetor 10. The nozzle body 102 has proximal and distal ends 104 and 106, respectively, and defines a longitudinal axis LA extending between the proximal and distal ends. The distal end 106 is configured to be positioned in the airflow passageway 16 of the barrel 14. As shown in FIG. 3, when coupled to the main body 12, the longitudinal axis LA of the nozzle 100 extends through and generally perpendicular to the central axis CA of the barrel 14. The nozzle body 102 defines a fuel inlet 108 (FIG. 3) configured to the receive fuel. For example, the fuel inlet 108 is fluidly coupled to one of the fuel bowls (not shown) that supplies fuel to the carburetor 10. The fuel inlet 108 is disposed on the proximal end 104 of the nozzle body 102.

The nozzle body 102 defines a two or more fuel outlets generally indicated at 110 configured to permit fuel to flow out of the nozzle body. The two or more fuel outlets 110 are spaced apart between the proximal and distal ends 104, 106 of the nozzle body 102. Preferably, the two or more fuel outlets 110 are spaced apart longitudinally along the longitudinal axis LA of the nozzle body 102. When mounted on the main body 12, the fuel outlets 110 are in open fluid communication with the airflow passageway 16 of the barrel 14 of the carburetor 10. The nozzle body 102 is sized and shaped to position the fuel outlets 110 in the airflow passageway 16 when the nozzle body is attached to the carburetor 10 so that the fuel flows into the airflow passageway of the carburetor and mixes with the air after the fuel flows out of the fuel outlets. As shown in FIG. 3, when the nozzle 100 is attached to the main body 12, the nozzle positions the fuel outlets 110 at transversely spaced locations in the airflow passageway 16 of the barrel 14.

The nozzle body 102 defines a fuel passage 112 that fluidly connects the fuel inlet 108 and the fuel outlets 110 so that fuel can flow from the fuel inlet to the fuel outlets. The fuel passage 112 extends from the proximal end 104 of the nozzle body 102 toward the distal end 106. The fuel inlet 108 is located at the proximal end of the fuel passage, and the distal end of the fuel passage is closed. The fuel passage 112 is generally parallel to the longitudinal axis LA. In the illustrated embodiment, the fuel passage 112 and fuel inlet 108 have circular cross-sectional shapes (FIG. 6), although other shapes are within the scope of the present disclosure. When attached, the fuel outlets 110 deliver fuel downward or with the flow direction of the air.

The nozzle body 102 includes a base portion 114, an extension portion 116 and a fuel delivery portion 118. The base portion 114 extends distally from the proximal end 104 of the nozzle body 102 is received in and engages the main body 12 of the carburetor. The base portion 114 includes a shoulder 120 that engages the main body 12 to position the nozzle 100 on the main body of the carburetor 10. In one embodiment, the base portion 114 and our extension portion are press fit into the carburetor main body 12 so that the nozzle 100 is sealed with the carburetor main body. The base portion 114 defines the fuel inlet 108 and a portion of the fuel passage 112. The extension portion 116 is sized and shaped to extend through a corresponding opening defined by a wall of the barrel 14. The extension portion 116 extends distally from the base portion 114 and defines a portion of the fuel passage 112. The fuel delivery portion 118 is sized and shaped to be disposed in the airflow passageway 16 of the carburetor 10 when the nozzle body 102 is attached to the carburetor. The fuel delivery portion 118 is configured to be inserted through the opening defined by the wall of the barrel 14 and positioned in the airflow passageway 16 when the base portion 114 engages the main body 12. The fuel delivery portion 118 extends distally from the extension portion 116 to the distal end 106 of the nozzle 100. The fuel delivery portion 118 defines the fuel outlets 110 and a portion of the fuel passageway 112. The fuel delivery portion 118 includes a midsection 122 configured to generally align with the middle (e.g., central axis CA) of the barrel 14 of the carburetor 10 when the nozzle body 102 is attached to the carburetor. The midsection 122 is illustrated as having a volume, but may be a line (i.e., having no volume) within the scope of the present invention.

Figure 6:
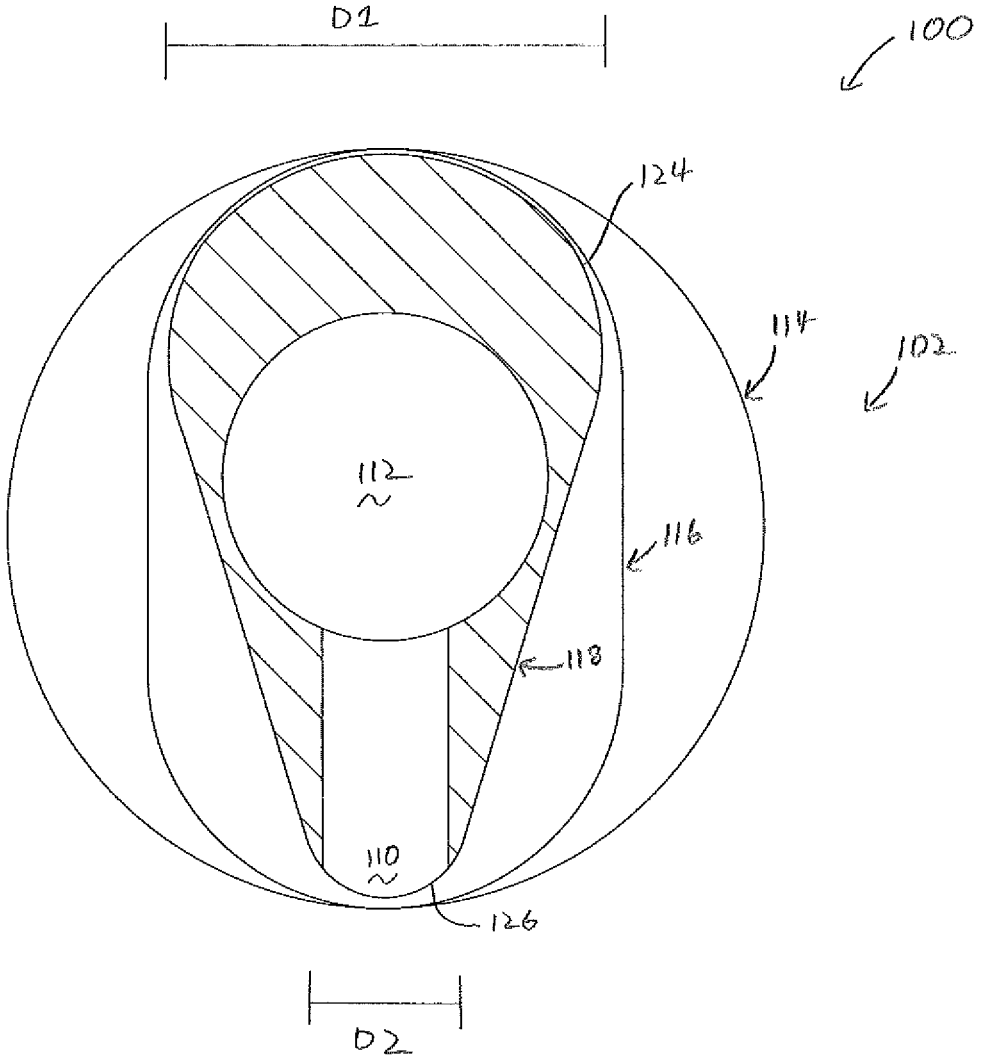
FIG. 6 is a section view taken through line 6-6 in FIG. 4.
Figure 7:
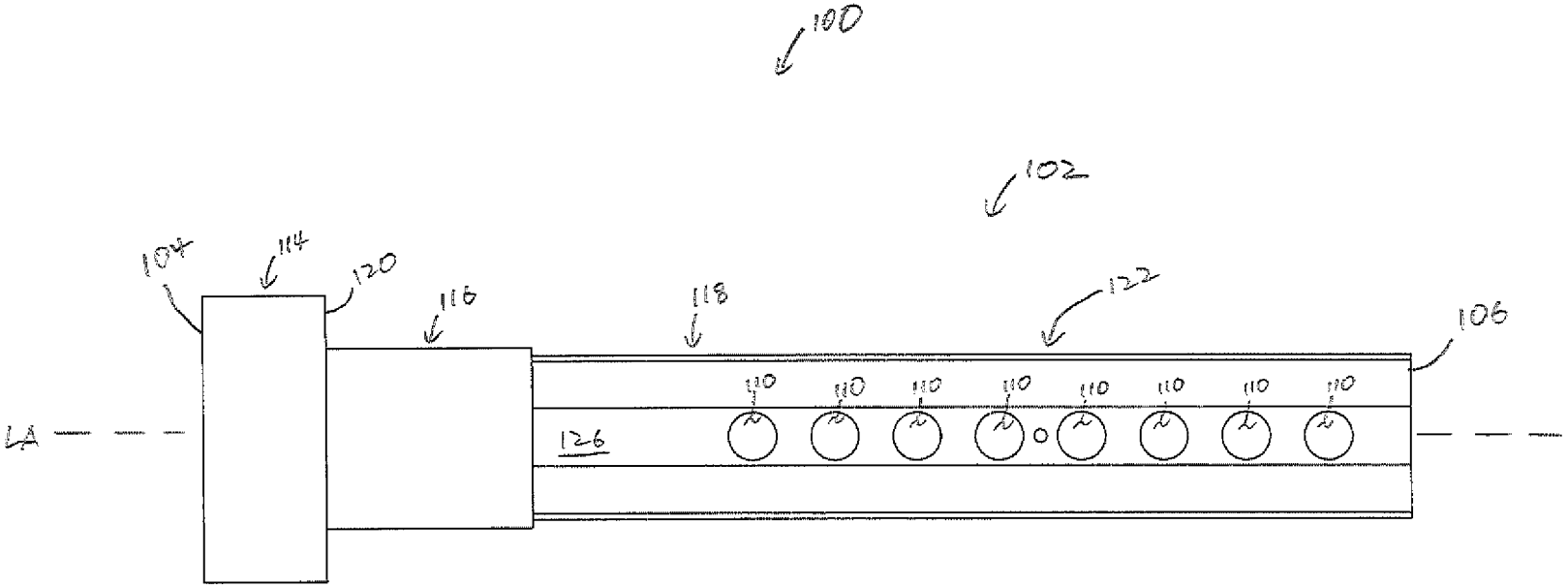
FIG. 7 is a bottom view thereof.

Referring to FIGS. 1 and 4-6, the fuel delivery portion 118 of the nozzle 100 has an airfoil shape configured to reduce turbulence caused by the passage of air in the airflow passageway 16 of the barrel 14 over the fuel delivery portion of the nozzle body 102 when the nozzle body is attached to the carburetor 10. As shown in FIG. 3, the nozzle 100, and more specifically the fuel delivery portion 118, extends in direction in the airflow passageway 16 that is generally perpendicular to the flow direction of the air through the airflow passageway when the nozzle is attached to the main body 12 of the carburetor 10. In the illustrated embodiment, the flow direction of the air is generally downward through each barrel 14. Accordingly, the longitudinal axis LA of the fuel delivery portion 118 of the nozzle 100 is generally perpendicular to the flow direction of the air. The fuel delivery portion 118 has an arcuate upper edge section 124 (e.g., leading edge section) and an opposite arcuate lower edge section 126 (e.g., trailing edge section). The fuel outlets 110 are located in the lower edge section 126. Each fuel outlet 110 extends downward from the fuel passage to the lower edge section 126. The fuel delivery portion 118 has a dimension D1 transverse to the longitudinal axis LA at the upper edge section 124 that is greater than a dimension D2 transverse to the longitudinal axis at the lower edge section 126 (FIG. 6). The fuel delivery portion 118 tapers from the upper edge section 124 to the lower edge section 126. Accordingly, a dimension transverse the longitudinal axis LA of the fuel delivery portion 118 tapers from the upper edge section 124 to the lower edge section 126. As illustrated, the tapering extends to a bottom edge of the fuel delivery portion 118.

The nozzle 100 is configured to provide the same fuel/air mixture to the two cylinders of the engine fed by the barrel 14 is the nozzle is disposed in. As mentioned above, each portion of the fuel/air mixture that flows on either side of throttle valve 18 feeds one of the cylinders of the engine. In currently existing carburetors, each cylinder fed by a single barrel of a carburetor typically receives different (e.g., unequal) fuel/air mixtures from the single barrel. Specifically, the distribution of fuel in the fuel/air mixture may not be uniform when the fuel/air mixture from the barrel reaches the cylinders. For example, for two cylinders fed by a single barrel, one cylinder may receive a fuel rich fuel/air mixture and the cylinder may receive a fuel lean fuel/air mixture. This unequal distribution of fuel prevents the cylinders and therefore the engine from operating at peak performance. The unequal distribution of the fuel/air mixture may be caused for a variety of factors, including but not limited to, the non-uniform flow of air into and through the airflow passageway, the throttle valve and the turbulences caused by the components through which the air and fuel/air mixture flows. Moreover, it is appreciated that these factors further move and redistribute the fuel discharged into the fuel passageway 16 as the fuel/air mixture flows to the cylinders of the engine, which may result in an equal or, more likely, unequal distribution of fuel in the fuel/air mixture. Accordingly, the exact distribution of the fuel/air mixture between cylinders fed by a single barrel of a carburetor may be unique to that barrel, with each barrel in the carburetor having a different distribution of the fuel/air mixture.

The nozzle 100, and other nozzles described herein, are configured to deliver fuel into the airflow passageway 16 of the barrel 14 in a manner that results in substantially the same (e.g., equal) distribution of fuel/air mixture being delivered to both cylinders fed by the barrel. Providing substantially the same fuel/air mixture to two cylinders of the engine fed by the barrel 14 of the carburetor 10 increases the performance of the engine. It is understood the teachings herein can apply to a barrel of the carburetor feeding (e.g., supplying) a fuel/air mixture to more than two cylinders. Accordingly, a barrel of a carburetor feeding two or more cylinders of an engine, such as but not limited to three or four cylinders, is within the scope of the present disclosure.

The fuel outlets 110 are arranged along the nozzle 100, specifically the fuel delivery portion 118, to provide substantially the same fuel/air mixture to two internal combustion engine cylinders fed by the barrel 14 of the carburetor 10 when the nozzle body 102 is attached other carburetor mounted on the internal combustion engine. The exact arrangement of the fuel outlets 110 depends upon the distribution of the fuel/air mixture between the two cylinders fed by each barrel 14. The nozzle 100 can deliver equal or unequal distributions of fuel into each side of the airflow passageway 16. Specifically, the fuel outlets 110 can be configured to deliver an equal distribution of fuel into the airflow passageway 16 of the carburetor 10 on opposite sides of the throttle valve 18 of the carburetor when the nozzle body 102 is attached to the carburetor. Alternatively, the fuel outlets 110 can be configured to deliver an unequal distribution of fuel into the airflow passageway 16 of the carburetor 10 on opposite sides of the throttle valve 18 of the carburetor when the nozzle body 102 is attached to the carburetor.

Referring to FIGS. 3-7, the two or more fuel outlets 110 are disposed on the nozzle 100 to deliver fuel to each side of the airflow passageway 16. The fuel outlets are configured to deliver fuel into the airflow passageway 16 at locations which are transversely spaced apart in the barrel 14 when the nozzle body 102 is attached to the main body 12 of the carburetor 10. The fuel outlets 110 are spaced apart along the longitudinal axis LA of the nozzle 100 on the fuel delivery portion 118. When attached to the main body 12, the longitudinal axis LA of the nozzle 100 extends generally transversely across the airflow passageway 16 (e.g., perpendicular to the central axis CA). The fuel delivery portion 118 defines fuel outlets 110 located on opposite sides (e.g., the proximal and distal sides) of the midsection 122 of the fuel delivery portion. At least one fuel outlet 110 is disposed proximally of the midsection 122 and at least one fuel outlet is disposed distally of the midsection. As mentioned above, when the nozzle 100 is attached to the main body 12, the midsection 122 of the fuel delivery portion 118 generally aligns with the central axis CA of the barrel 14. Thus, the fuel outlets 110 are disposed on the fuel delivery portion 118 of the nozzle body 102 so that at least one fuel outlet will deliver fuel to each side of the airflow passageway 16. As a result, when the nozzle 100 is attached to the main body 12, at least one fuel outlet 110 is disposed over one side of the throttle valve 18 and at least one fuel outlet is disposed over the opposite side of the throttle valve.

The fuel outlets 110 can have a variety of configurations and arrangements depending upon the nature of the distribution of the fuel/air mixture between the two cylinders fed by the barrel 14 of the carburetor 10. In some embodiments, the fuel outlets are all arranged generally in a line. The exact configuration and arrangement of the fuel outlets 110 on the fuel delivery portion 118 determines the distribution of the fuel/air mixture being delivered to the two cylinders fed by the barrel 14. In practice, a user selects the nozzle that has a fuel outlet 110 configuration and arrangement that will result in substantially the same fuel/air mixture being delivered to the two cylinders of the engine fed by the barrel 14 of the carburetor 10 when the nozzle is mounted to the carburetor. Preferably, the total number of fuel outlets 110 in the fuel delivery portion 118 of the nozzle 100 is in the inclusive range of five to eight fuel outlets. In addition, the number of fuel outlets on one side of the midsection 122 of the fuel delivery portion 118 may be the same as the number of fuel outlets on the other side of the midsection. Alternatively, the number of fuel outlets 110 on one side of the midsection 122 of the fuel delivery portion 118 may be different from the number of fuel outlets on the other side of the midsection. Preferably, the number of fuel outlets 110 on one side of the midsection 122 of the fuel delivery portion 118 is in the inclusive range of one to four fuel outlets and the number of fuel outlets on the opposite side of the midsection makes up the difference between the total number of fuel outlets and the number of fuel outlets on the one side of the midsection 122.

In one embodiment, the spacing between adjacent fuel outlets 110 on one side of the midsection 122 having three or more fuel outlets is constant. In one embodiment, the spacing between adjacent fuel outlets 110 on one side of the midsection 122 is the same as the spacing of the fuel outlets on the other side of the midsection. In another embodiment, the spacing between adjacent fuel outlets 110 on one side of the midsection 122 is different from the spacing of the fuel outlets on the other side of the midsection. In one embodiment, the spacing between adjacent fuel outlets may be 0.125 in (3.18 mm), 0.156 in (3.96 mm), and/or 0.25 in (6.35 mm) on center. Each fuel outlet 110 has a cross-sectional area. The cross-sectional areas for the fuel outlets can be the same or different. In one embodiment, the cross-sectional area of each of the fuel outlets 110 on one side of the midsection 122 is the same. In one embodiment, the cross-sectional areas of the fuel outlets 110 on one side of the midsection 122 are different (e.g., smaller, larger) from the cross-sectional areas of the fuel outlets on the other side of the midsection. In the illustrated embodiment, each fuel outlet has a circular cross-sectional shape with a diameter, although other shapes and sizes are within the scope of the present disclosure. In one embodiment, the diameter of each fuel outlet 110 may be 0.073 in (1.85 mm), 0.082 in (2.08 mm), 0.089 in (2.26 mm) or 0.096 in (2.44 mm).

Figure 8:
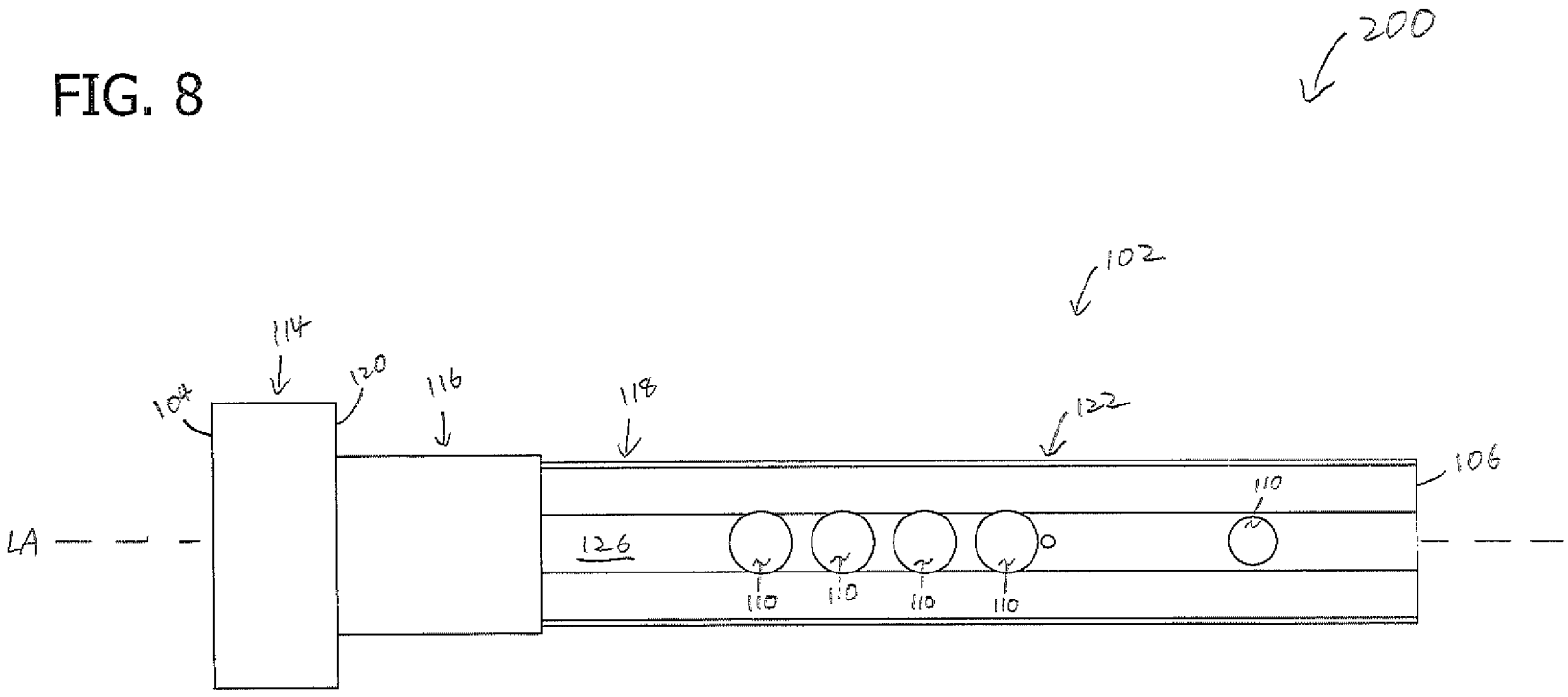
FIG. 8 is a bottom view of another embodiment of a fuel discharge nozzle according to the teachings of the present disclosure.
Figure 11:
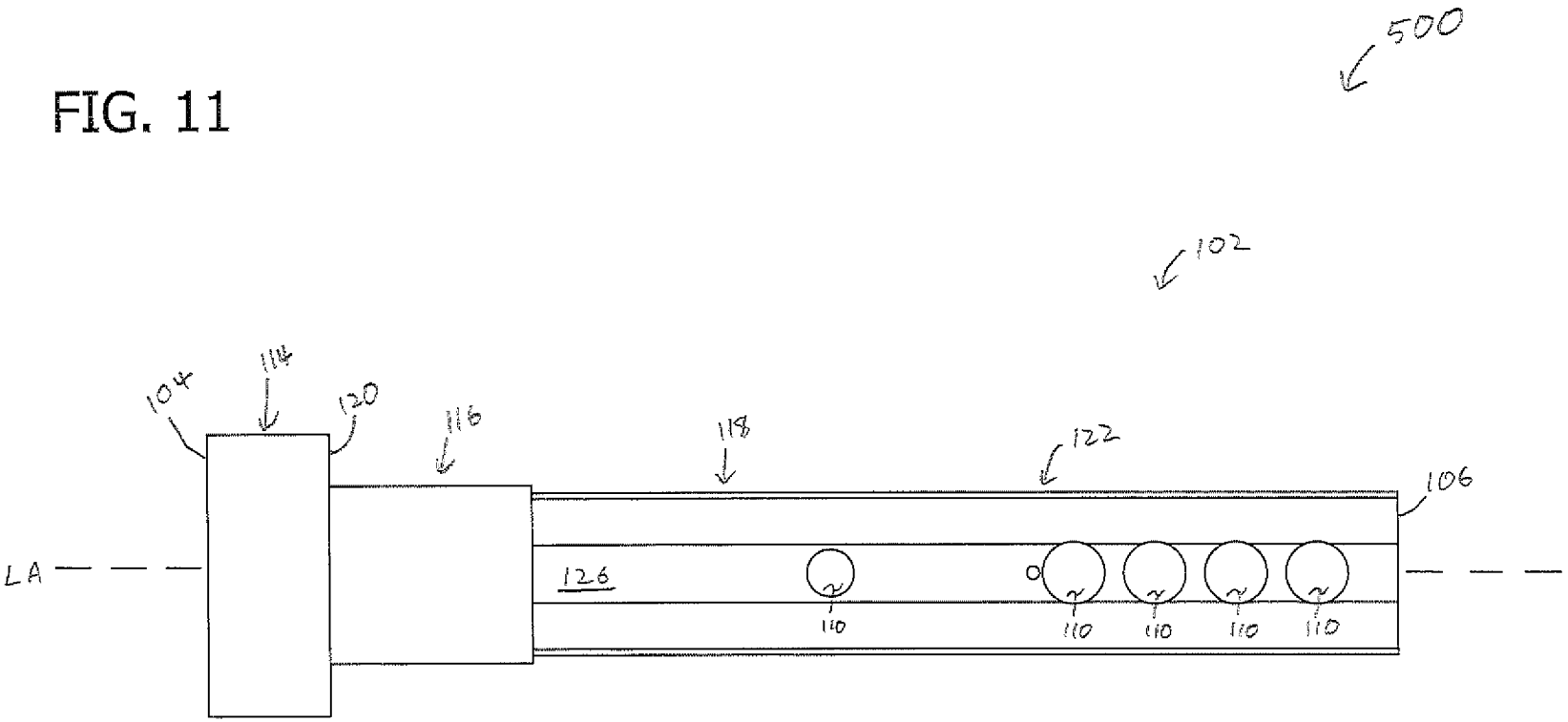
FIG. 11 is a bottom view of another embodiment of a fuel discharge nozzle according to the teaching of the present disclosure.

In the embodiment shown in FIGS. 1-7, the nozzle 100 includes eight fuel outlets 110, with four fuel outlets on each side of the midsection 122. In this embodiment, the fuel outlets 110 all have the same cross-sectional area and spacing, such as a diameter of 0.073 in (1.86 mm) and a spacing of 0.125 in (3.18 mm). In the embodiment shown in FIG. 8, nozzle 200 includes five fuel outlets 110, with four fuel outlets on the proximal side of the midsection 122 and one fuel outlet on the distal side of the midsection. In this embodiment, the fuel outlets 110 on the proximal side of the midsection 122 each have a larger cross-sectional area than the fuel outlet on the distal side. The fuel outlets 110 on the proximal side of the midsection 122 have a diameter of 0.096 in (2.44 mm) at a spacing of 0.125 in (3.18 mm). The fuel outlet 110 on the distal side has a diameter of 0.073 in (1.86 mm) and is positioned on the fuel delivery portion 118 to be disposed near the middle of the distal side of the airflow passageway 16 when the nozzle 200 is attached to the main body 12 of the carburetor 10. Nozzle 500 in FIG. 11 is similar to nozzle 200 except that the four fuel outlets 110 are on the distal side of the midsection 122 and the one fuel outlet is on the proximal side of the midsection.

Figure 9:
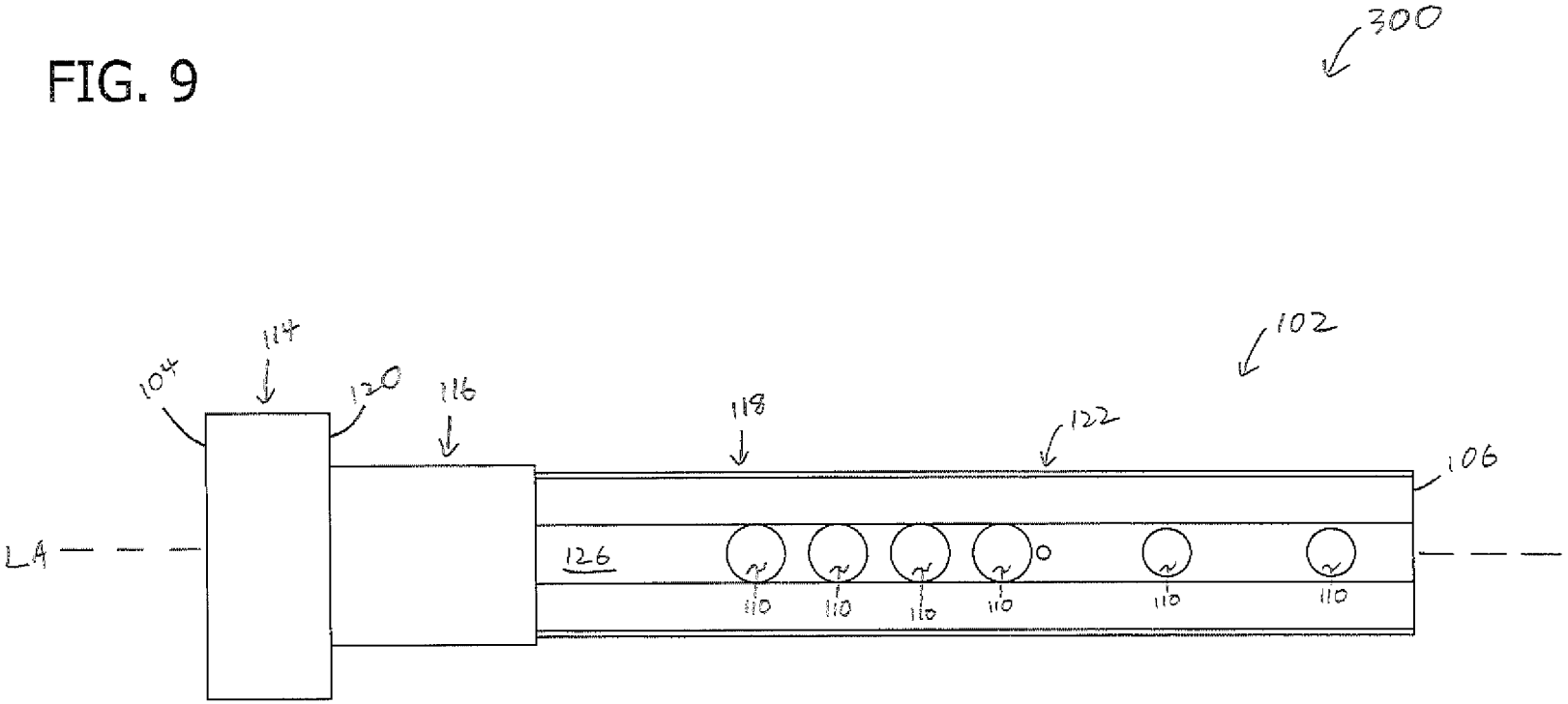
FIG. 9 is a bottom view of another embodiment of a fuel discharge nozzle according to the teaching of the present disclosure.
Figure 12:
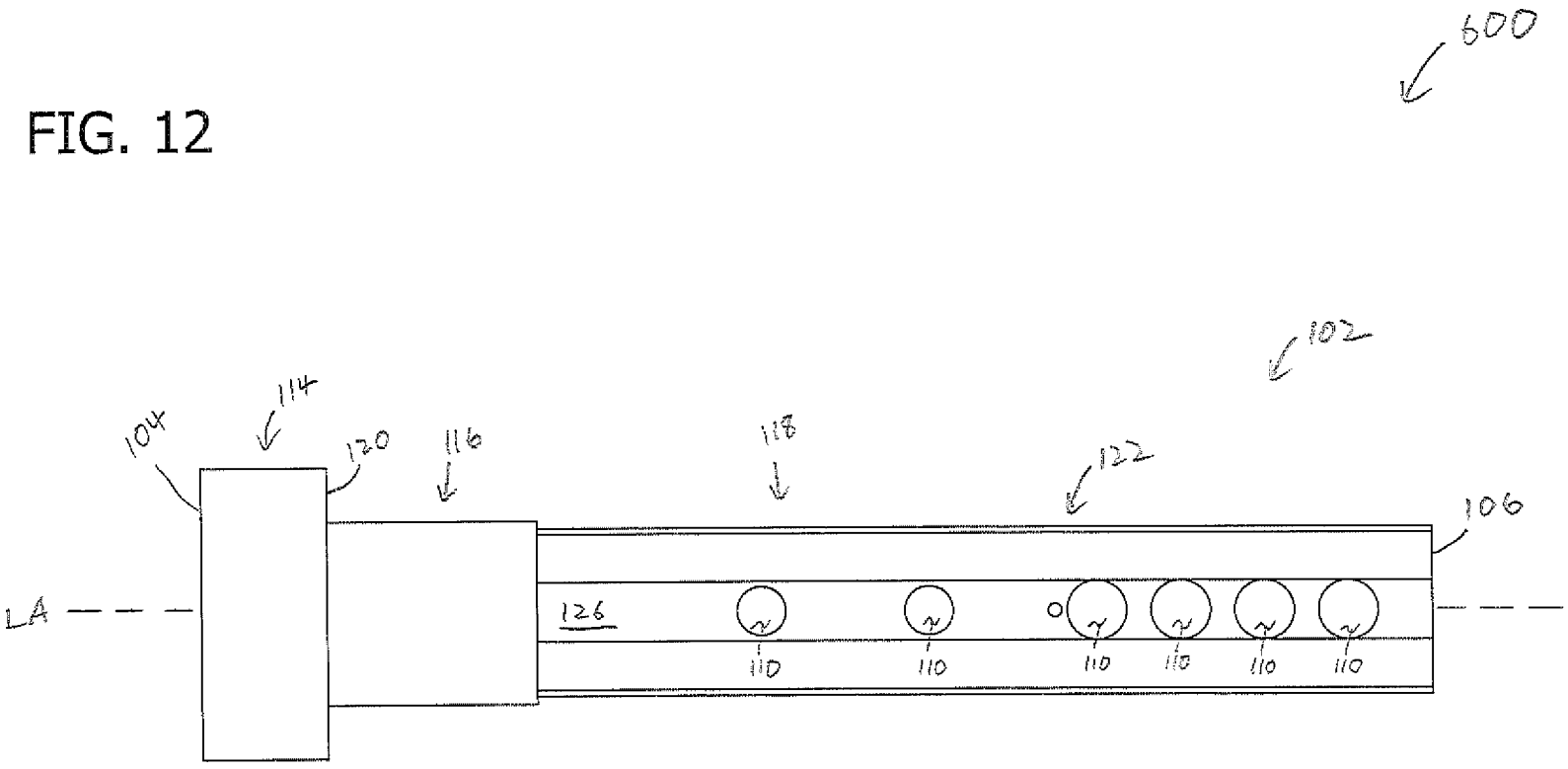
FIG. 12 is a bottom view of another embodiment of a fuel discharge nozzle according to the teaching of the present disclosure.

In the embodiment shown in FIG. 9, nozzle 300 includes six fuel outlets 110, with four fuel outlets on the proximal side of the midsection 122 and two fuel outlets on the distal side of the midsection. In this embodiment, the fuel outlets 110 on the proximal side of the midsection 122 have a larger cross-sectional area than the fuel outlets on the distal side and a smaller spacing. The fuel outlets 110 on the proximal side of the midsection 122 have a diameter of 0.089 in (2.26 mm) at a spacing of 0.125 in (3.18 mm). The fuel outlets 110 on the distal side have a diameter of 0.073 in (1.86 mm) at a spacing of 0.25 in (6.35 mm). The two fuel outlets 110 on the distal side are positioned on the fuel delivery portion 118 to be disposed near the middle of the distal side of the airflow passageway 16 when the nozzle 300 is attached to the main body 12 of the carburetor 10. Nozzle 600 in FIG. 12 is similar to nozzle 300 except that the four fuel outlets 110 are on the distal side of the midsection 122 and the two fuel outlets are on the proximal side of the midsection.

Figure 10:
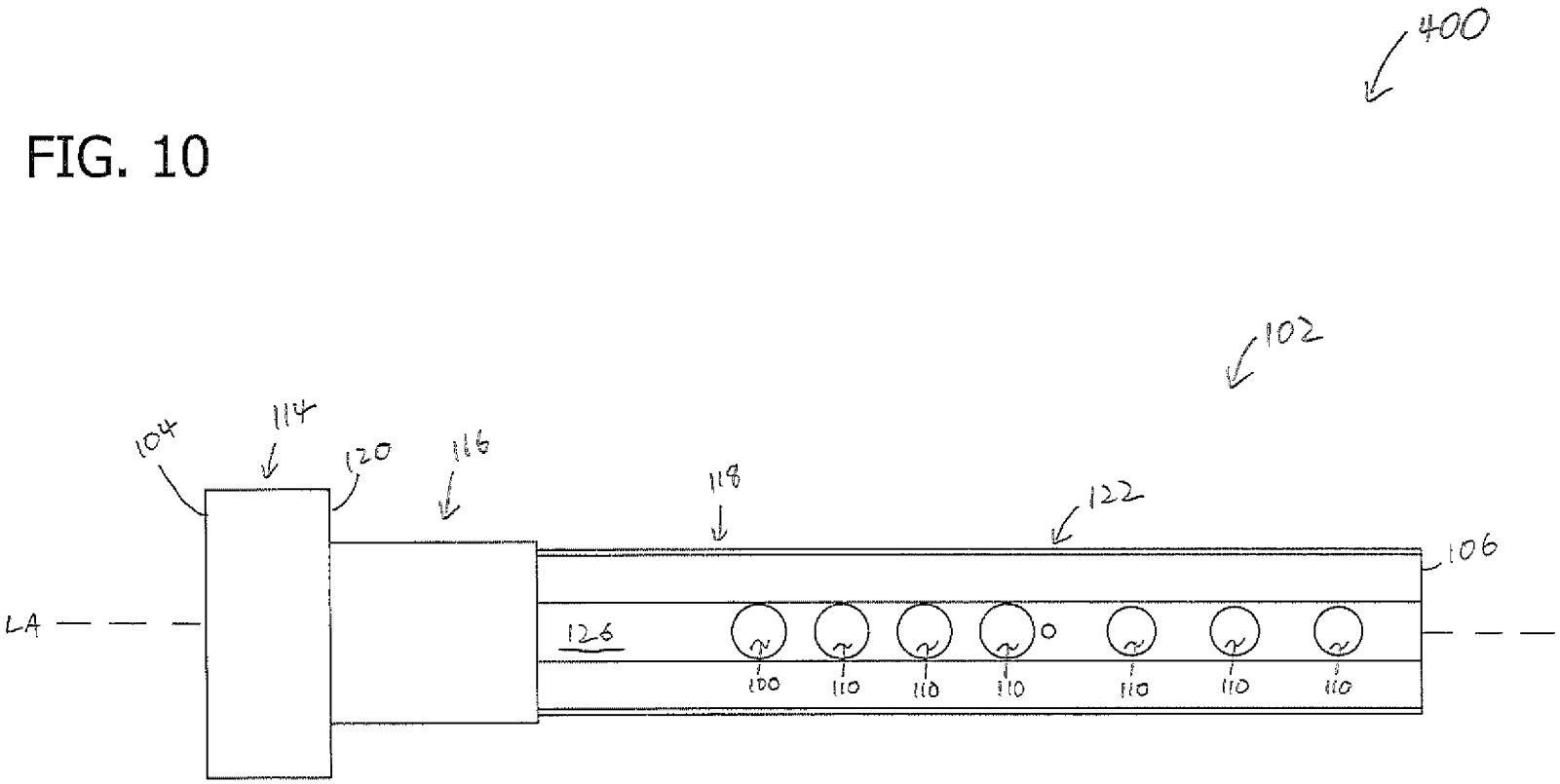
FIG. 10 is a bottom view of another embodiment of a fuel discharge nozzle according to the teaching of the present disclosure.
Figure 13:
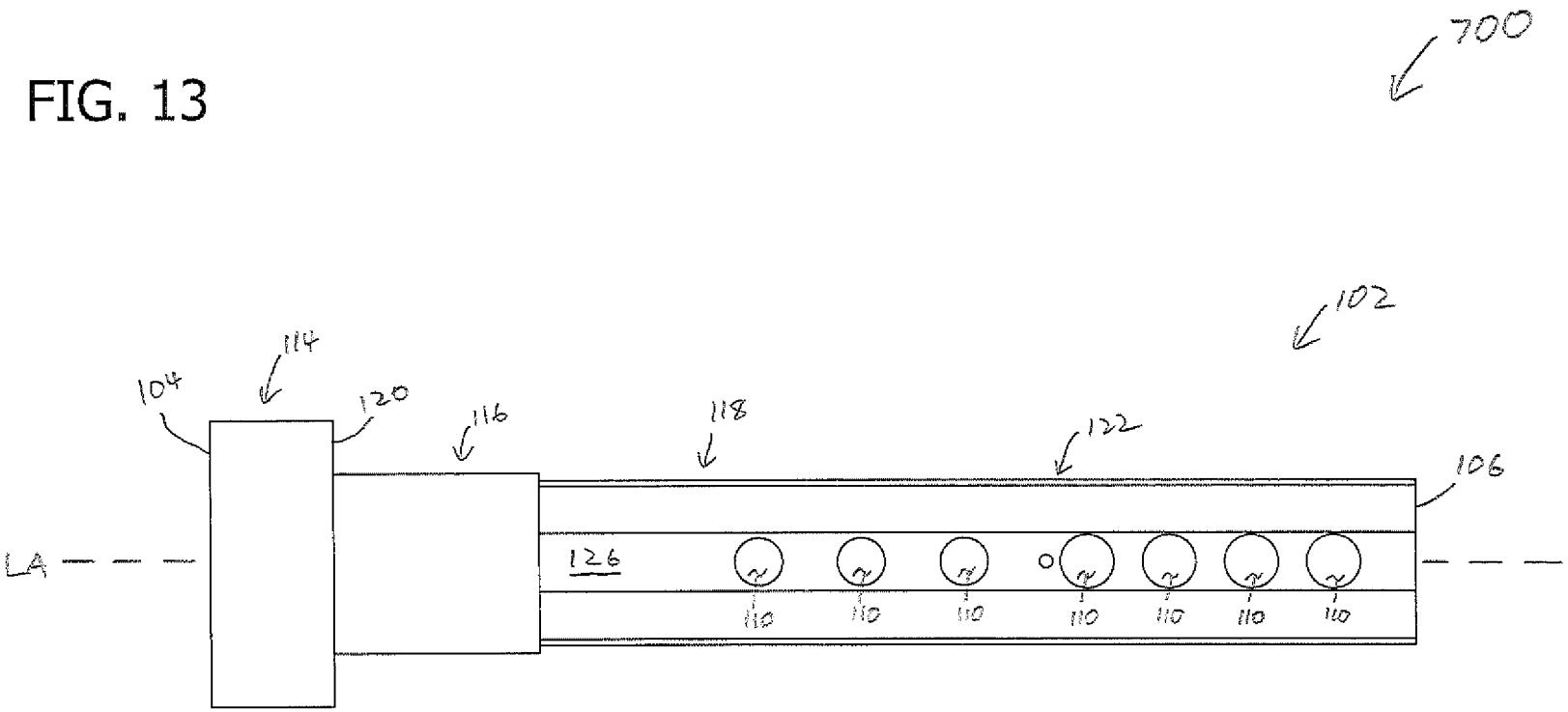
FIG. 13 is a bottom view of another embodiment of a fuel discharge nozzle according to the teaching of the present disclosure.

In the embodiment shown in FIG. 10, nozzle 400 includes seven fuel outlets 110, with four fuel outlets on the proximal side of the midsection 122 and three fuel outlets on the distal side of the midsection. In this embodiment, the fuel outlets 110 on the proximal side of the midsection 122 have a larger cross-sectional area than the fuel outlets on the distal side and a smaller spacing. The fuel outlets 110 on the proximal side of the midsection 122 have a diameter of 0.082 in (2.08 mm) at a spacing of 0.125 in (3.18 mm). The fuel outlets 110 on the distal side have a diameter of 0.073 in (1.86 mm) at a spacing of 0.156 in (3.96 mm). Nozzle 700 in FIG. 13 is similar to nozzle 300 except that the four fuel outlets 110 are on the distal side of the midsection 122 and the three fuel outlets are on the proximal side of the midsection.

Other configurations and arrangements of the fluid outlets are within the scope of the present invention. For example, the longitudinal positioning between the proximal and distal ends 104, 106 of the one or more fuel outlets 110 on each side of the midsection 122 can vary. The diameters of the fuel outlets 118 can also be selected to affect the fuel distribution. Except for the configuration and arrangement of the fuel outlets 110, the nozzles 200, 300, 400, 500, 600 and 700 are identical to nozzle 100. Thus, for ease of comprehension, where identical or analogous parts are used, identical reference numerals are employed.

Each configuration and arrangement of the fuel outlets 110 described herein delivers fuel to each side of the airflow passageway 16 of the barrel 14 in different amounts. The user selects the nozzle with the fuel outlet 110 configuration and arrangement that will deliver the appropriate amount of fuel to each side of the airflow passage 16 that will result in substantially the same fuel/air mixture being delivered to the two cylinders fed by the barrel 14. Depending upon the exact characteristics of the flow path between the nozzle and the cylinders, fuel that is delivered in unequal amounts to each side of the airflow passage 16 by a nozzle 200, 300, 400, 500, 600, 700 will more evenly redistributed along the flow path such that substantially the same fuel/air mixture enters both cylinders. Similarly, depending upon the exact characteristics of the flow path between the nozzle and the cylinders, fuel that is delivered in equal amounts to each side of the airflow passage 16 by a nozzle 100 may remain evenly distributed in the fuel/air mixture when the fuel/air mixture reaches the cylinders such that substantially the same fuel/air mixture enters both cylinders.

To tune the carburetor 10 to provide fuel/air mixtures to the two cylinders of the internal combustion engine fed by each barrel 14 of the carburetor the user must first determine that a fuel/air mixture from the carburetor to each of the two cylinders deviates from a standard (e.g., optimal) fuel/air mixture. This determination may be made using tests and techniques generally known in the art. For example an engine may be attached to an engine dynamometer that provides data on torque, horsepower, pressure and fuel/air mixture in the individual cylinders. The tests and techniques used to determine the deviation can also provide values indicating whether the fuel/air mixture delivered to each cylinder is either rich or lean when compared to the standard fuel/air mixture. Once the cylinders receiving a rich fuel/air mixture and a lean fuel/air mixture are identified, the user selects a nozzle 100-700 with a configuration and arrangement of fuel outlets 110 that will initially distribute the fuel into the sides of the airflow passageway 16 in such a way that will bring the fuel/air mixture delivered to at least one of the cylinders closer to the standard air/fuel mixture. In other words, the user installs a nozzle into the carburetor that is constructed to deliver a different amount of fuel on one side of the airflow passageway 16 of the barrel 14 than the other side of the airflow passageway to bring the fuel/air mixture of at least one of the two cylinders closer to the standard fuel/air mixture. In some embodiments, the selected nozzle may bring both cylinders closer to the standard fuel/air mixture. It is envisioned that as few as one fuel outlet could be used to tune the cylinder. The fuel outlet could be sized and located anywhere along the nozzle to achieve the desired fuel/air mixture to both cylinders.

For example, if the portion of the fuel/air mixture flowing on the distal side of the throttle valve 18 and going to one cylinder is lean and the portion of the fuel/air mixture flowing on the proximal side of the throttle valve and going to the other cylinder is rich, the user may select one of nozzles 500, 600, or 700, which deliver more fuel to the distal side and less fuel to the proximal side of the airflow passageway 16. In this example, the exact nozzle 500, 600, 700 selected to be mounted on carburetor 10 depends upon the difference between the rich and lean portions of the fuel/air mixture with the standard fuel/air mixture and which nozzle will deliver the appropriate proportions of the fuel to each side of the airflow passageway 16 such that by the time the fuel/air mixture is directed into each cylinder, substantially the same fuel/air mixture (e.g., standard fuel mixture) is delivered to both cylinders. It is appreciated that both cylinders may receive a rich or lean fuel/air mixture, which may indicate an inappropriate amount of fuel is entering the airflow passageway 16, instead of or in addition to the fuel/air mixture being unequally distributed between the cylinders. The nozzles 100-700 are configured to be retrofit into existing carburetors.

Tests conducted on engines having a carburetor outfitted with the nozzles described herein demonstrated increased performance. Specifically, tests were conducted with engines having a horsepower between 700 hp and 900 hp before the addition of the nozzles 100-700. The fuel/air mixture being delivered to each cylinder was determined and then the existing nozzles in the carburetor of each engine were replaced with nozzles 100-700, as described herein. As a result, the horsepower generated by each engine having a carburetor outfitted with nozzles 100-700 significantly increased by about 25-30 hp.

Having described the invention in detail, it will be apparent that modifications and variations are possible without departing from the scope of the invention defined in the appended claims. For example, where specific dimensions are given, it will be understood that they are exemplary only and other dimensions are possible.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. A fuel discharge nozzle for discharging fuel into an airflow passageway of a barrel of a carburetor, the fuel discharge nozzle comprising:

an elongate nozzle body configured to be attached to the carburetor and having proximal and distal ends, the nozzle body defining a fuel inlet configured to receive fuel, at least one fuel outlet configured to permit the fuel to flow out of the nozzle body, and a fuel passage fluidly connecting the fuel inlet and the at least one fuel outlet so that the fuel can flow from the fuel inlet to the at least one fuel outlet, the nozzle body being sized and shaped to position the at least one fuel outlet in the airflow passageway of the barrel of the carburetor when the nozzle body is attached to the carburetor so that the fuel flows into the airflow passageway of the carburetor and mixes with air after the fuel flows out of the at least one fuel outlet;

wherein the nozzle body comprises a fuel delivery portion sized and shaped to be disposed in the airflow passageway when the nozzle body is attached to the carburetor, the fuel delivery portion having an airfoil shape configured to reduce turbulence caused by passage of air in the airflow passageway over the fuel delivery portion of the nozzle body when the nozzle body is attached to the carburetor.

2. The fuel discharge nozzle as set forth in claim 1 wherein the fuel delivery portion has a longitudinal axis and a midsection generally aligned with the middle of the barrel of the carburetor when the nozzle body is attached to the carburetor, the at least one fuel outlet including a plurality of fuel outlets spaced apart along the longitudinal axis and located on opposite sides of the midsection of the fuel delivery portion.

3. The fuel discharge nozzle as set forth in claim 2 wherein the number of fuel outlets on one side of the midsection of the fuel delivery portion is the same as on the other side of the midsection of the fuel delivery portion.

4. The fuel discharge nozzle as set forth in claim 2 wherein the number of fuel outlets on one side of the midsection of the fluid delivery portion is different from the number of fuel outlets located on the other side of the midsection of the fuel delivery portion.

5. The fuel discharge nozzle as set forth in claim 4 wherein a total number of the fuel outlets in the fuel delivery portion is in the inclusive range of five to eight fuel outlets.

6. The fuel discharge nozzle as set forth in claim 5 wherein the number of fuel outlets on one side of the midsection of the fuel delivery portion is in the inclusive range of one to four fuel outlets, and the number of fuel outlets on the opposite side of the midsection of the fuel delivery portion makes up the difference between the total number of the fuel outlets in the fuel delivery portion and the number of fuel outlets on said one side of the midsection of the fuel delivery portion.

7. The fuel discharge nozzle as set forth in claim 2 wherein the spacing between adjacent fuel outlets on one of the opposite sides of the midsection of the fuel delivery portion having more than three fuel outlets is constant.

8. The fuel discharge nozzle as set forth in claim 1, wherein the at least one fuel outlet is arranged along the fuel delivery portion of the nozzle body to provide substantially the same fuel/air mixture to two internal combustion engine cylinders fed by the barrel of the carburetor when the nozzle body is attached to the carburetor mounted on the internal combustion engine.

9. The fuel discharge nozzle as set forth in claim 2, wherein the fuel outlets are configured to deliver fuel into the carburetor barrel at locations which are transversely spaced apart in the barrel when the nozzle body is attached to the carburetor.

10. The fuel discharge nozzle as set forth in claim 2 wherein the fuel outlets are configured to deliver an unequal distribution of fuel into the airflow passageway of the carburetor on opposite sides of a throttle valve of the carburetor when the nozzle body is attached to the carburetor.

11. The fuel discharge nozzle as set forth in claim 2, wherein there are plural fuel outlets disposed on one side of the midsection of the fuel delivery portion, said plural fuel outlets disposed on one side of the midsection of the fuel delivery portion being of the same size.

12. The fuel discharge nozzle as set forth in claim 2, wherein one of the fuel outlets that is disposed on one side of the midsection of the fuel delivery portion of the nozzle body is smaller than one of the fuel outlets disposed on the opposite side of the midsection of the fuel delivery portion.

13. The fuel discharge nozzle as set forth in claim 1, wherein the fuel delivery portion is configured to extend in a direction in the airflow passageway that is generally perpendicular to a flow direction of the flow of air through the airflow passageway when the nozzle body is attached to the carburetor such that a longitudinal axis of the fuel delivery portion is generally perpendicular to the flow direction.

14. The fuel discharge nozzle as set forth in claim 13 wherein the fuel delivery portion has an upper edge section and a lower edge section, the fuel outlets being located in the lower edge section.

15. The fuel discharge nozzle as set forth in claim 14 wherein the fuel delivery portion has a greater transverse dimension at the upper edge section than at the lower edge section.

16. The fuel discharge nozzle as set forth in claim 15 wherein the transverse dimension of the fuel delivery portion tapers from the upper edge section to the lower edge section.

17. A carburetor for an internal combustion engine having at least at least two combustion cylinders, the carburetor comprising a body having at least one barrel formed therein defining an airflow passageway for the passage of air from outside the carburetor into the two cylinders of the internal combustion engine when the carburetor is attached to the internal combustion engine, a throttle valve disposed in the barrel for controlling the amount of fuel and air that is passed from the barrel to the cylinders of the internal combustion engine, the throttle valve being constructed so that air and fuel flow on opposite sides of the throttle valve, and a nozzle mounted on the carburetor body and extending transversely across the barrel upstream of the throttle valve, the nozzle having an airfoil shape and defining a fuel inlet configured to receive fuel, at least one fuel outlet configured to permit the fuel to flow out of the nozzle, and a fuel passage fluidly connecting the fuel inlet and the fuel outlet so that the fuel can flow from the fuel inlet to the at least one fuel outlet, the nozzle positioning the at least one fuel outlet in the airflow passageway of the barrel of the carburetor so that the fuel flows into the airflow passageway of the carburetor and mixes with air as the fuel flows through the at least one fuel outlet.

18. The carburetor as set forth in claim 17 wherein the nozzle comprises a plurality of fuel outlets at transversely spaced apart locations in the barrel, a different number of the fuel outlets being disposed over one side of the throttle valve than is disposed over an opposite side of the throttle valve.

19. A method of tuning a carburetor to provide fuel/air mixtures to two cylinders of an internal combustion engine fed by a single barrel of the carburetor, the method comprising:

determining that a fuel/air mixture from the carburetor to at least one of the two cylinders deviates from a standard fuel/air mixture; and installing a nozzle having an airfoil shape into the carburetor that is constructed to deliver fuel to an airflow passageway of the barrel so that the fuel/air mixture of at least one of the two cylinders is brought closer to the standard fuel/air mixture.

* * * * *